US006488539B1

(12) United States Patent
Turek et al.

(10) Patent No.: US 6,488,539 B1
(45) Date of Patent: Dec. 3, 2002

(54) ELECTRICAL CONNECTOR

(75) Inventors: James Turek, LaGrange, IL (US); James M. Komaniecki, Clarendon Hills, IL (US); Kenneth Irish, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/957,364

(22) Filed: Sep. 20, 2001

(51) Int. Cl.[7] ..... H01R 13/66
(52) U.S. Cl. ..... 439/620; 439/188; 439/404
(58) Field of Search ..... 439/620, 404, 439/188

(56) References Cited

U.S. PATENT DOCUMENTS

| | | | | | |
|---|---|---|---|---|---|
| 3,985,416 | A | | 10/1976 | Dola et al. | 439/403 |
| 4,113,341 | A | * | 9/1978 | Hughes | 439/620 |
| 4,210,382 | A | * | 7/1980 | Culbertson | 439/620 |
| 4,552,429 | A | | 11/1985 | van Alst | 439/403 |
| 4,820,956 | A | * | 4/1989 | Slobodzian et al. | 439/620 |
| 4,846,701 | A | * | 7/1989 | Hayes et al. | 439/620 |
| 4,952,169 | A | | 8/1990 | Hayes, Sr. | 439/403 |
| 5,009,612 | A | | 4/1991 | Rishworth et al. | 439/403 |
| 5,026,305 | A | * | 6/1991 | Del Guidice et al. | 439/620 |
| 5,199,899 | A | | 4/1993 | Ittah | 439/403 |
| 5,338,220 | A | | 8/1994 | Soes et al. | 439/403 |
| 5,397,251 | A | | 3/1995 | Kaminski | 439/620 |
| 5,647,761 | A | * | 7/1997 | Kaminski | 439/620 |
| 6,220,890 | B1 | * | 4/2001 | Turek et al. | 439/459 |
| 6,312,288 | B1 | * | 11/2001 | Genz et al. | 439/628 |

* cited by examiner

*Primary Examiner*—P. Austin Bradley
*Assistant Examiner*—Briggitte R. Hammond
(74) *Attorney, Agent, or Firm*—Welsh & Katz, Ltd.; Mark W. Croll; Paul F. Donovan

(57) ABSTRACT

An insulated electrical connector is used with an associated switch. The switch includes three protruding co-planar switch terminals parallel and spaced from one another. The connector includes first, second, and third contacts positioned within an insulating housing that has at least three cavities parallel to one another. Each contact is positioned within the housing so that the connector is configured to receive external conductors and the associated switch terminals.

23 Claims, 9 Drawing Sheets

ELECTRICAL CONNECTOR

BACKGROUND OF THE INVENTION

The present invention relates generally to an insulated connector, and more particularly to insulated connectors for use with switches. The connector may be used with sub-miniature switches, and more particularly, with push button sub-miniature switches.

Switches are well known and can be used in various electro-mechanial devices, such as video games, vending machines, and control apparatuses. Push button switches are one type of switch that can incorporate normally open, normally closed and common terminals. Push button switches are often used in vending machines, video games, slot machines and the like. These switches can be used to allow a user to operate a computer animated figure in a video game, to order a refreshment beverage in a vending machine, or to play a 'hand' in a slot machine.

Many of these devices have a limited amount of space for switch placement, and the switches are generally part of an electrical circuit that requires external conductors to remain in electric contact with the switch terminals. Typically, the conductors are soldered onto the terminals of the switches, and the ends of the conductors are terminated at the terminals. It is imperative that the conductors are soldered onto the appropriate switch terminals to allow for proper switch functionality. Because space within the devices is limited, this process is very tedious and can result in manual error during installation.

To protect the switch or adjacent components from early burn out, a circuit element, such as a diode, is often placed across two of the switch terminals. Typically, circuit element leads are soldered onto the switch terminals. It is crucial that the circuit element leads are connected onto the appropriate switch terminals for proper switch functionality. Again, because space within the devices is limited, this process is tedious and can result in manual error.

In addition, the switches often times work in conjunction with another electrical device, such as a lamp as part of an electrical assembly. Often, the lamp is positioned vertically above or below the switch and has two terminals protruding therefrom. Like the switch, the lamp requires external conductors to remain in electric contact with the lamp terminals. Some circuits require the lamp to be connected to the circuit via an electrical circuit element and an external conductor. The conductors and/or circuit element leads are typically soldered onto the lamp terminals and then terminated. Similar to the switch, the conductors and/or circuit element leads must be connected to the appropriate lamp terminals for proper functionality of the lamp in the electrical circuit. This process is also very tedious and can result in manual error during installation.

In the past, external conductors and/or circuit element leads were manually soldered onto the appropriate switch and electrical device terminals, increasing manual error and labor manufacturing costs.

Accordingly, there continues to be a need for an insulated electrical connector that eases the process of connecting a switch to a circuit within an apparatus. Preferably, such a connector eliminates most, if not all of the circuit element soldering otherwise required for these devices. Further, such a connector also avoids the need for multiple, individual connectors for each switch or lamp terminal.

SUMMARY OF THE INVENTION

The present invention relates generally to insulated connectors. A first embodiment of a connector of the invention is configured for use with an associated switch. The switch includes three protruding co-planar switch terminals parallel and spaced from one another. The connector comprises first, second, and third contacts. Each contact includes a terminal receiving portion configured to cooperate with one of the associated three switch terminals and an external conductor receiving portion configured to cooperate with an external conductor.

The first embodiment of the connector also includes an insulating housing having at least three cavities parallel to one another and defining a cavity plane. Each cavity includes a terminal receiving portion and a first conductor opening formed therein.

Each contact is positioned within the housing so that the terminal receiving portions of each contact and cavity are substantially aligned. The conductor receiving portion and the conductor openings of the contacts and cavities are substantially aligned and configured to receive an external conductor transverse to the cavity plane.

A second embodiment of the invention is an insulated connector for use with an associated electrical assembly that has upper and lower terminals vertically spaced from one another. The insulated connector comprises at least one upper contact, at least one lower terminal contact, and at least one lower circuit element contact. The second embodiment also includes an insulated housing that has at least one upper cavity, at least one lower terminal cavity, and at least one lower circuit element cavity. The second embodiment also includes at least one circuit element that has first and second leads.

The upper contacts, lower terminal contacts, and lower circuit element contacts are positioned within the upper cavities, lower terminal cavities, and lower circuit element cavities of the housing so that the connector is configured to receive upper and lower terminals of the associated electrical assembly, and external conductors. The first and second leads of the circuit element are interposed within the contacts so that the upper contacts and lower circuit element contacts are in electrical contact with one another.

Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
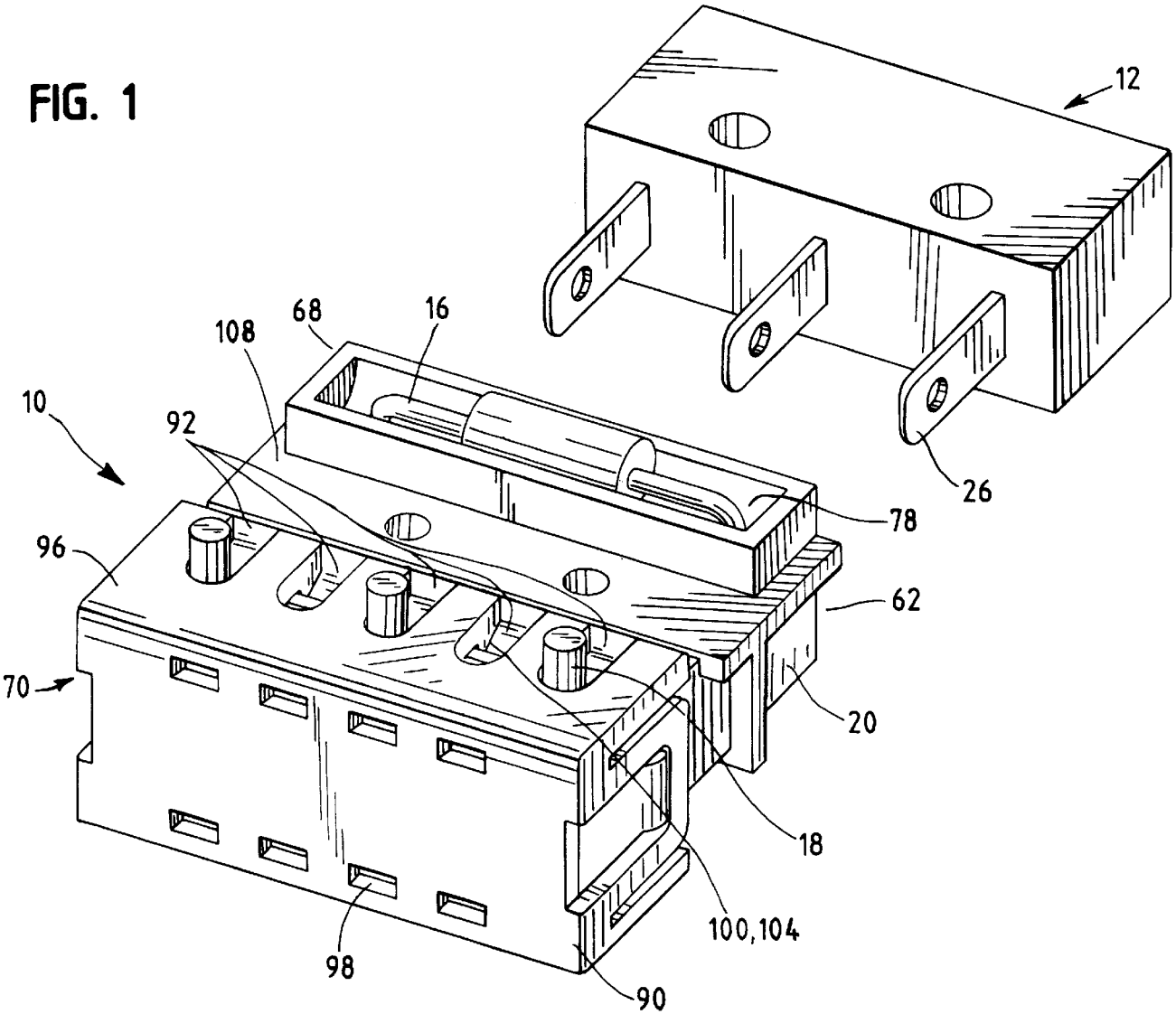
FIG. 1 depicts a first embodiment of an electrical connector pursuant to aspects of the invention in cooperation with a three position switch, and further depicts an end member, a circuit element, and an external conductor in cooperation with the connector.

While the present invention is susceptible of embodiment in various forms, there is shown in the drawings and will hereinafter be described a specific embodiment with the understanding that the present disclosure is to be considered an exemplification of the invention and is not intended to limit the invention to the specific embodiment illustrated.

It should be further understood that the title of this section of this specifically, normally, "Detailed Description of the Invention," relates to a requirement of the United States Patent and Trademark Office, and does not imply, nor should be referred to limit the subject matter disclosed and claimed herein.

The present insulated connectors 10, 200 are configured for use with switches 12 and electrical assemblies 14. Connectors 10, 200 incorporating aspects of the invention provide for a compact connector and reliable electrical contact between a switch 12 or electrical assembly 14, which may include circuit elements 16, and external conductors 18.

Connectors 10, 200 of the invention include a housing 20, 208 with cavities 22, 210, 212, 214 formed therein, and contacts 24, 202, 204, 206 positioned within the cavities 22, 210, 212, 214.

Figure 2:
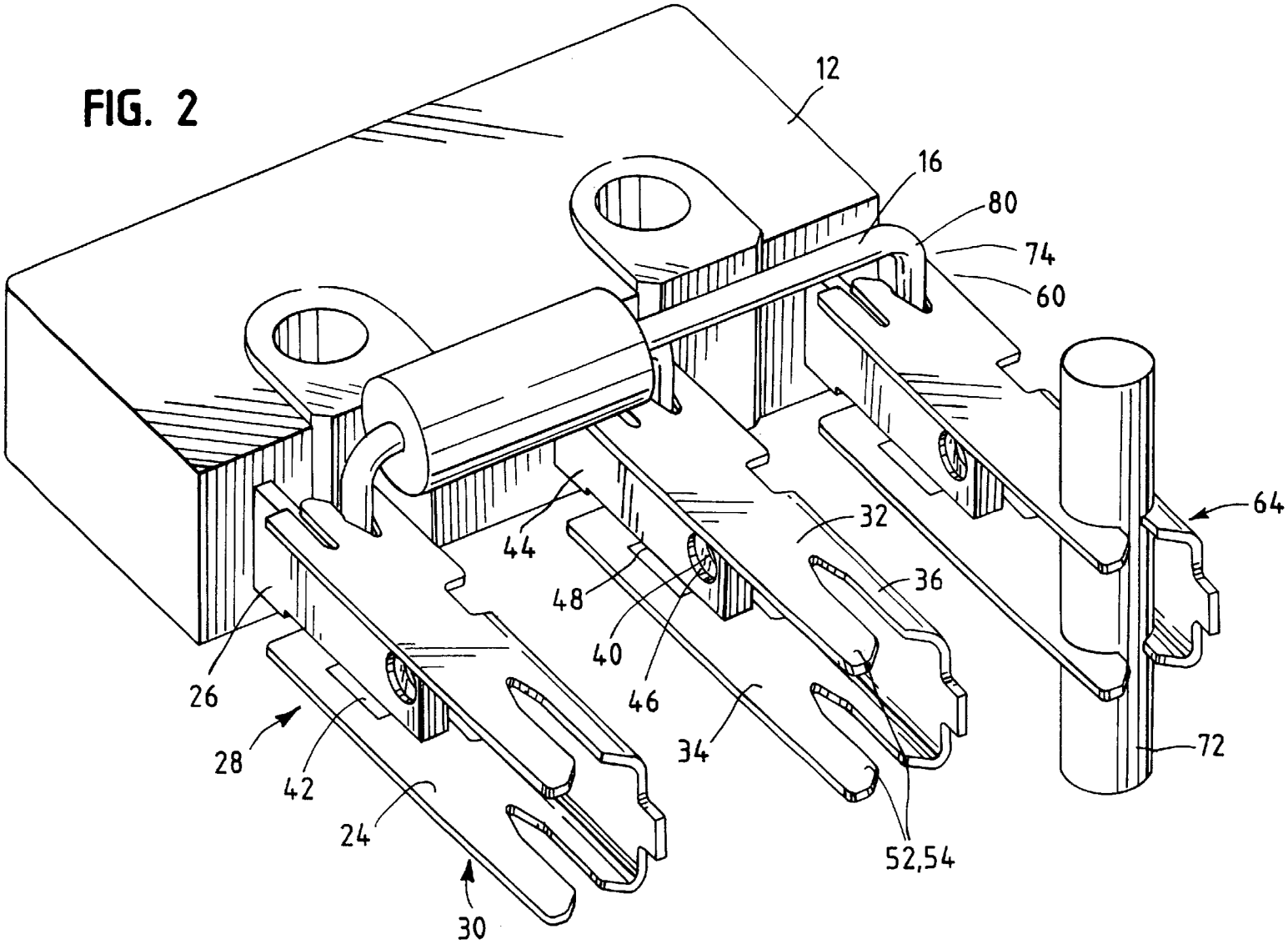
FIG. 2 illustrates a contact design and a contact configuration incorporated in the first embodiment of FIG. 1 in cooperation with a three position switch having three terminals, and is shown with an external conductor and a circuit element in cooperation therewith.
Figure 5:
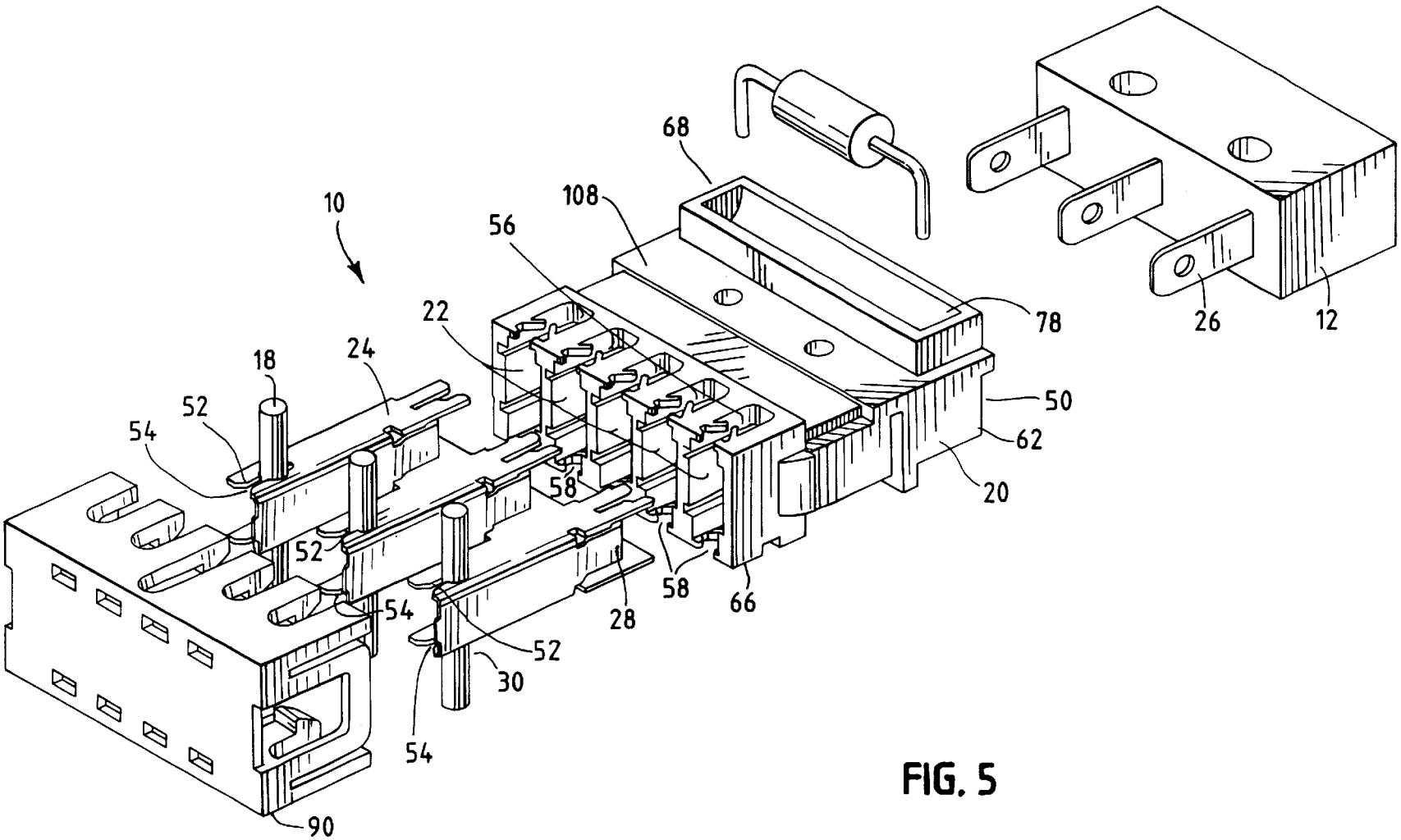
FIG. 5 is an exploded view of a second embodiment of a connector pursuant to aspects of the invention in cooperation with a switch having three terminals, and showing external conductors, a circuit element, and an end member in cooperation with the connector.

FIG. 1 depicts a first embodiment 10 of a connector incorporating aspects of the invention in connection with a three position switch 12 having three terminals 26 (FIGS. 2 and 5). The connector 10 includes at least one contact, and is shown in FIGS. 2 and 5 incorporating three contacts 24. The connector also includes a housing 20 (FIGS. 3 and 5) having at least three cavities 22 formed therein. The connector preferably includes five cavities formed therein, as shown in FIGS. 1–3, and 5. It should be noted that connectors 10, 200 can also function with other switches 12 that incorporate a different number of terminals and that also have a different number of positions. A different number of terminals would require a different number of connector cavities and contacts, and a different number of switch positions would dictate the number of external conductors to be connected to the connector.

FIG. 2 shows contacts 24 having a terminal receiving portion 28 configured to cooperate with the terminals 26 of the switch 12, and an external conductor receiving portion 30 configured to cooperate with an external conductor 18. Preferably, the contacts 24 are formed having first (top) 32 and second (bottom) 34 surfaces parallel to one another, and a third (lateral) 36 surface substantially orthogonal to and extending between the first and second surfaces 32, 34. In a preferred embodiment, a loaded beam 38, which can include a dimple 40 (FIGS. 2 and 4) formed thereon, can be formed on the contact third surface 36. A portion 42 of the second surface 34 can also be cut away.

The terminal receiving portions 28 of the contacts 24 cooperate with the switch terminals 26 by receiving the terminals 26 within the space defined by first, second, and third surfaces 32, 34, 36 of the contacts 24. Specifically, when the connector 10 is connected to the switch 12, the loaded beam 38 abuts against a lateral side 44 of the terminal 26, and the dimple 40 of the loaded beam 38 cooperates with an aperture 46 formed within the terminal 26. Further, a bottom end 48 of the terminal 26 is guided and locked into place by the cut away portion 42 of the second surface 34. Each terminal 26 thus "clicks" into the connector 10 and is in constant electrical contact with its respective contact 24.

Figure 3:
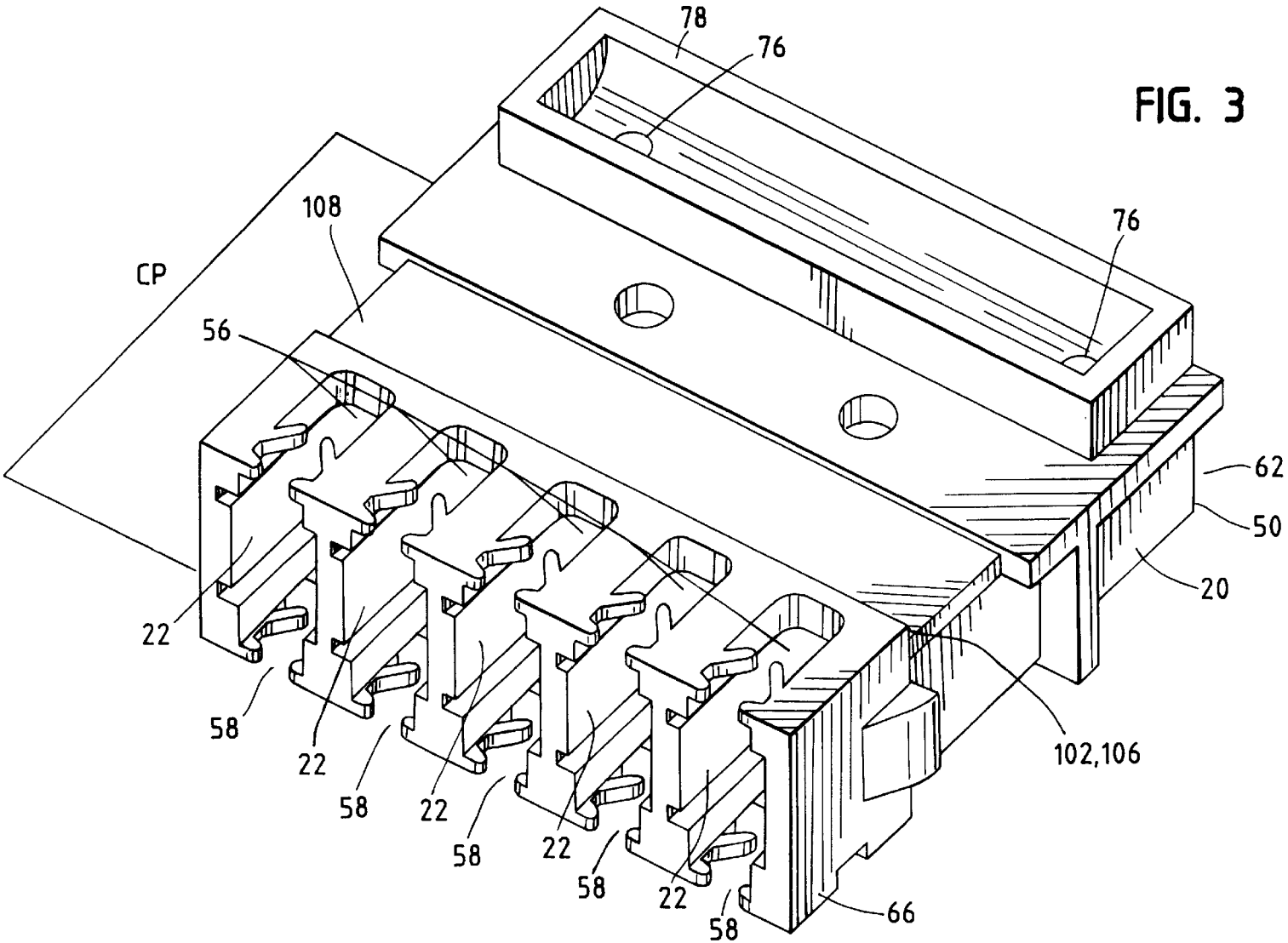
FIG. 3 depicts a housing incorporated in the first embodiment with five cavities and a circuit element receiving recess formed therein.

The housing 20 should have at least three cavities 22 formed therein, and is shown in FIG. 3 with five cavities 22 formed therein. The cavities 22 can be parallel to one another and define a cavity plane CP (FIG. 3). A terminal receiving portion 50 of each cavity 22 is configured to cooperate with the switch terminals 26 (FIG. 5). The contacts 24 are positioned within the cavities 22 so that the terminal receiving portions 28, 50 of the contacts 24 and cavities 22 are substantially aligned. Thus, the terminal receiving portion 50 of each cavity 22 also receives a corresponding switch terminal 26 when the switch 12 is connected to the connector 10. The cavities 22 of the housing 20 insulate the contacts 24 from one another so that the contacts 24 are not in electrical contact with one another.

The embodiment of FIG. 2 shows the external conductor receiving portions 30 of the contacts 24 including first and second insulation displacement connector grooves 52, 54. The insulation displacement connector grooves 52, 54 are formed within the first and second surfaces 32, 34 of the contacts 24. As shown in FIG. 2, the external conductor receiving portions 30 of the contacts 24 cooperate with the external conductors 18 by receiving the conductors 18 within the first and second insulation displacement connector grooves 52, 54. It should be noted that in other embodiments, not shown, the external conductor receiving portion 30 can include only one insulation displacement connector groove formed on the first or second surface 32, 34.

FIGS. 3 and 5 shows first and second conductor openings 56, 58 formed within the cavities 22 of the housing 20. The first and second conductor openings 56, 58 are substantially aligned with the first and second grooves 52, 54 of the contacts 24. As shown in FIGS. 1 and 5, this allows for the external conductors 18 to be received in the conductor openings 56, 58 and insulation displacement connector grooves 52, 54 transverse, and preferably substantially orthogonal, to the cavity plane CP.

Preferably, as shown in FIGS. 2–3, the external conductor receiving portions 30 of the contacts 24 and external conductor openings 56, 58 of the housing are formed at respective distal ends 64, 66 of the contacts 24 and cavities 22, and the terminal receiving portions 28, 50 of the contacts 24 and cavities 22 are formed at their respective proximal ends 60, 62. This configuration advantageously allows the connector 10 to be connected to the switch 12 at a proximal end 68 of the connector 10 (FIGS. 1 and 5), and the external conductor 18 to be inserted within the conductor receiving portions 30 and conductor openings 56, 58 of the contacts 24 and cavities 22 at a distal end 70 of the connector 10. Thus, the configuration provides spacing between the terminal 26 and conductor 18, which in turn, if desired, allows for easier termination of a free end 72 of the external conductor 18. It should be noted, however, that the conductor receiving portions 30 and the conductor openings 56, 58 need not be at the proximal end 60, 62 of the contacts 24 and cavities 22, and the terminal receiving portions 28, 50 need not be at the distal end 64, 66 of the contacts 24 and cavities 22.

Figure 4:
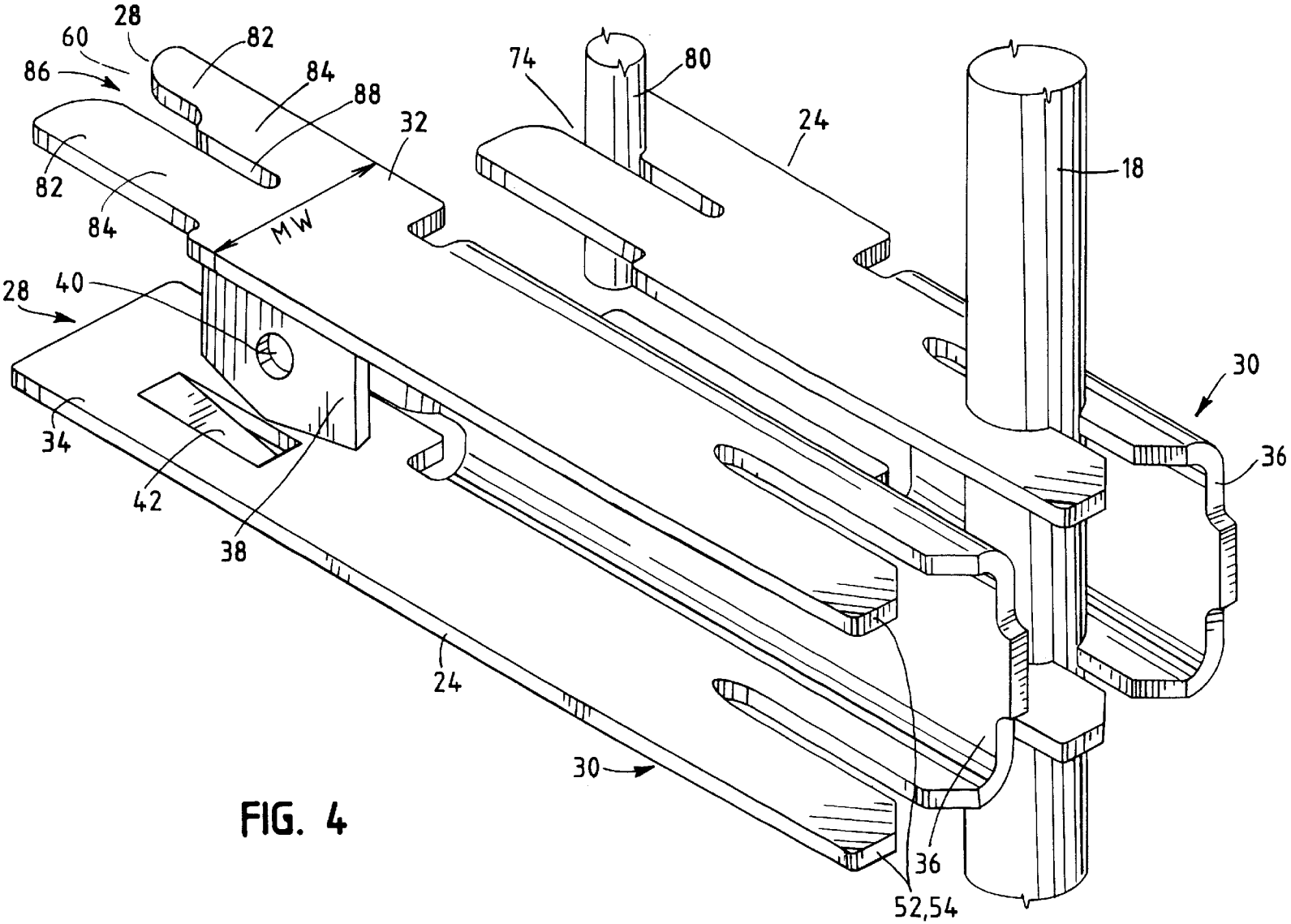
FIG. 4 is a partial enlarged view of a preferred circuit element receiving portion and a preferred terminal receiving portion configured for incorporation in contacts of first and second embodiments of the invention.

Electrical circuits may require a circuit element 16 connected across switch terminals 26. In such a configuration, connectors 10 for such circuits incorporate contacts 24 that include circuit element lead receiving portions 74, as shown in FIGS. 2 and 4. It should be noted that, although FIGS. 2 and 4 show the circuit element lead receiving portion 74 in proximity to the terminal receiving portion 28, this need not be the case. The connectors 10 for circuits requiring circuit elements 16 also incorporate a housing 20 that includes circuit element lead apertures 76 formed therein, as shown in FIG. 3. Preferably, each cavity 22 includes one circuit element lead aperture 76 formed therein, although this need not be the case. FIG. 3 shows that the housing 20 can have a circuit element receiving recess 78. The contacts 24 are positioned in the housing 20 so that the circuit element lead. receiving portions 28 and circuit element lead apertures 76 are substantially aligned. The circuit element 16 can then be placed within the circuit element receiving recess 78 of the housing 20 so that the circuit element leads 80 are interposed within two of the circuit element lead apertures 76, as shown in FIG. 1.

An enlarged view of an embodiment of the circuit element lead receiving portion 74 is shown in FIG. 4. In this embodiment, a first set of insulation displacement connector beams 82 are formed on a second set of insulation displacement connector beams 84, which are formed on the first surface 32 of the contact 24. The first set of insulation displacement connector beams 82 form a wide groove 86 and the second set of the insulation displacement connector beams 84 form a narrow groove 88.

The configuration and design of the two sets of insulation displacement connector beams 82, 84 shown in FIG. 4 provide for reliable and constant electrical contact between the circuit element 16 and the contact 24, and also provide for compact contacts 24 and connectors 10. Specifically, the first set of insulation displacement connector beams 82 grasps one of the circuit element leads 80 with an interference fit, which allows for permanent circuit element lead 80 deformation. The second set of insulation displacement connector beams 84 provide most of the deflection while still requiring only a minimum gap between the second set of the insulation displacement connector beams 84. The minimum gap decreases the minimal width MW of the first (top) surface 32 of the contact 24, and thus reduces overall contact 24 and connector 10 width. The reduction in connector width is beneficial because of the spacing constraints within some of the devices in which connectors 10 are incorporated.

In addition, the design of the two sets of insulation displacement connector beams 82, 84 allows the contacts 24 to "lock" the leads 80 of the circuit element 16 within the beams 82, 84 when the contacts 24 are inserted into the housing 20. As a result, the circuit element 16 is in electrical contact with two of the contacts 24. Preferably, the connector 10, with the circuit element 16 connected thereto, is connected to the switch 12 so that, as described above, the switch terminals 26 are in electrical contact with the contacts 24, and thus the circuit element 16. In turn, the external conductors 18 can be inserted into the connector 10 so that, as described above, they are received within the conductor receiving portion 30 and conductor openings 56, 58, and in electrical contact with the contacts 24. Note that the two sets of insulation displacement connector beams 82, 84 are illustrated and described while incorporated on a lower terminal contact 204 of a second embodiment 200 of the invention. The IDC beams 82, 84 would typically be incorporated in circuit element receiving portions 74, 236, 248 of contacts 24 in the first embodiment 10, and of upper contacts 202 and lower circuit element contacts 206 in the second embodiment 200.

Figure 6:
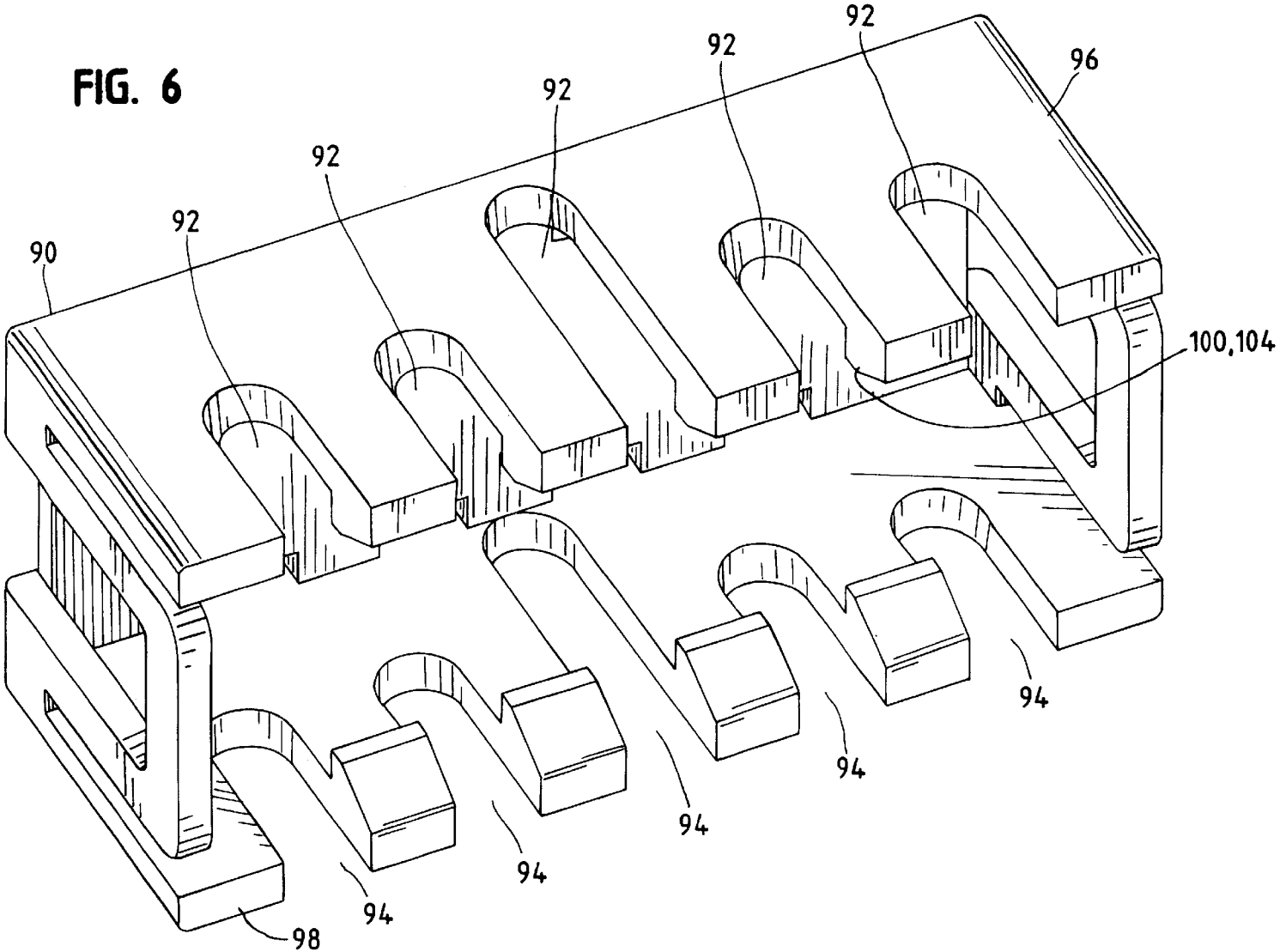
FIG. 6 illustrates an end member incorporated in the first embodiment of the connector including five upper and lower apertures formed therein.

As shown in FIGS. 1, 2 and 5, the connector 10 can also include an end member 90 for cooperation with the distal end 70 of the connector 10. The end member 90 preferably includes at least three upper and at least three lower apertures 92, 94 formed on the top and bottom surfaces 96, 98 of the end member 90. The end member of FIGS. 1, 2 and 6 includes five upper and lower apertures 92, 94 formed on the top and bottom surfaces 96, 98 of the end member. In addition, the end member 90 can have a male connector 100 and the housing 20 can have a female connector 102 to allow the end member 90 to cooperate with the housing 20. As shown in FIGS. 1, 3 and 5, the end member male connector 100 can be formed as a ledge 104 depending from the top surface 96 of the end member 90, and the housing female connector 102 can be a ledge 106 formed on a top surface 108 of the housing 20. As shown in FIG. 1, the housing 20 and the end member 90 cooperate with one another so that the first and second conductor openings 56, 58 of each cavity are substantially aligned with the five upper and three lower apertures 92, 94 of the end member 90. If desired, after the end member 90 is connected to the connector 10, free ends 72 (FIG. 4) of the external conductors 18 that extend from the end member 90 lower apertures 94 can then be terminated.

Figure 7:
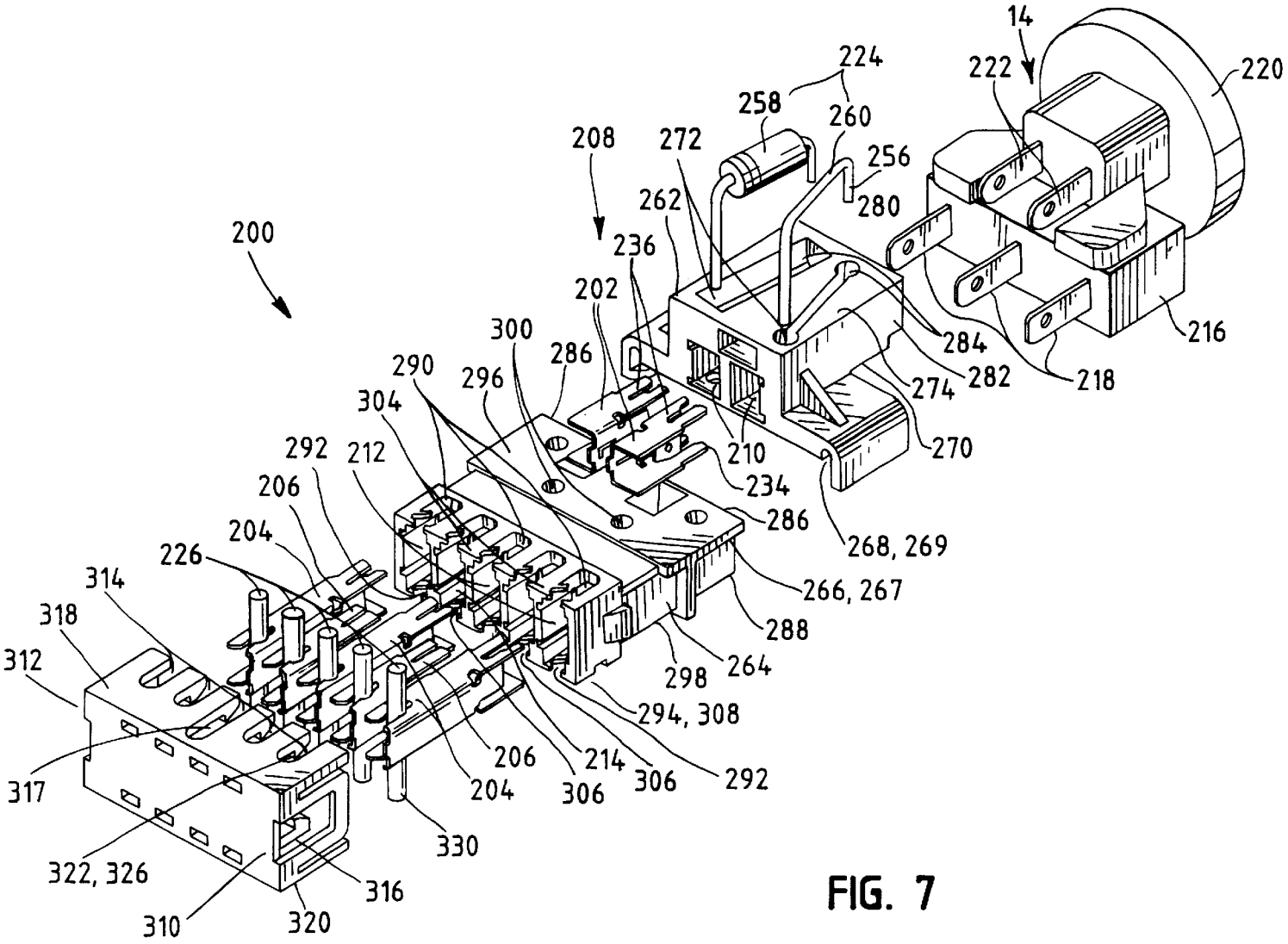
FIG. 7 is an exploded view of a second embodiment of a connector pursuant to aspects of the invention in cooperation with an electrical assembly having upper and lower terminals, and showing external conductors, circuit elements, and end member in cooperation with the connector.

FIG. 7 depicts an exploded view of a second embodiment 200 of a connector incorporating different types of contacts 202, 204, 206 and a housing 208 with cavities 210, 212, 214 formed therein. FIG. 7 shows the second embodiment 200 in cooperation with an electrical assembly 14. The electrical assembly 14 includes a five position switch 216 having three (lower) terminals 218 integral with an electrical device (lamp) 220 having two (upper) terminals 222. It should be noted that connectors of the invention can also function with other electrical assemblies 14 that incorporate a different number of terminals, and switches having a different number of positions.

Figure 8:
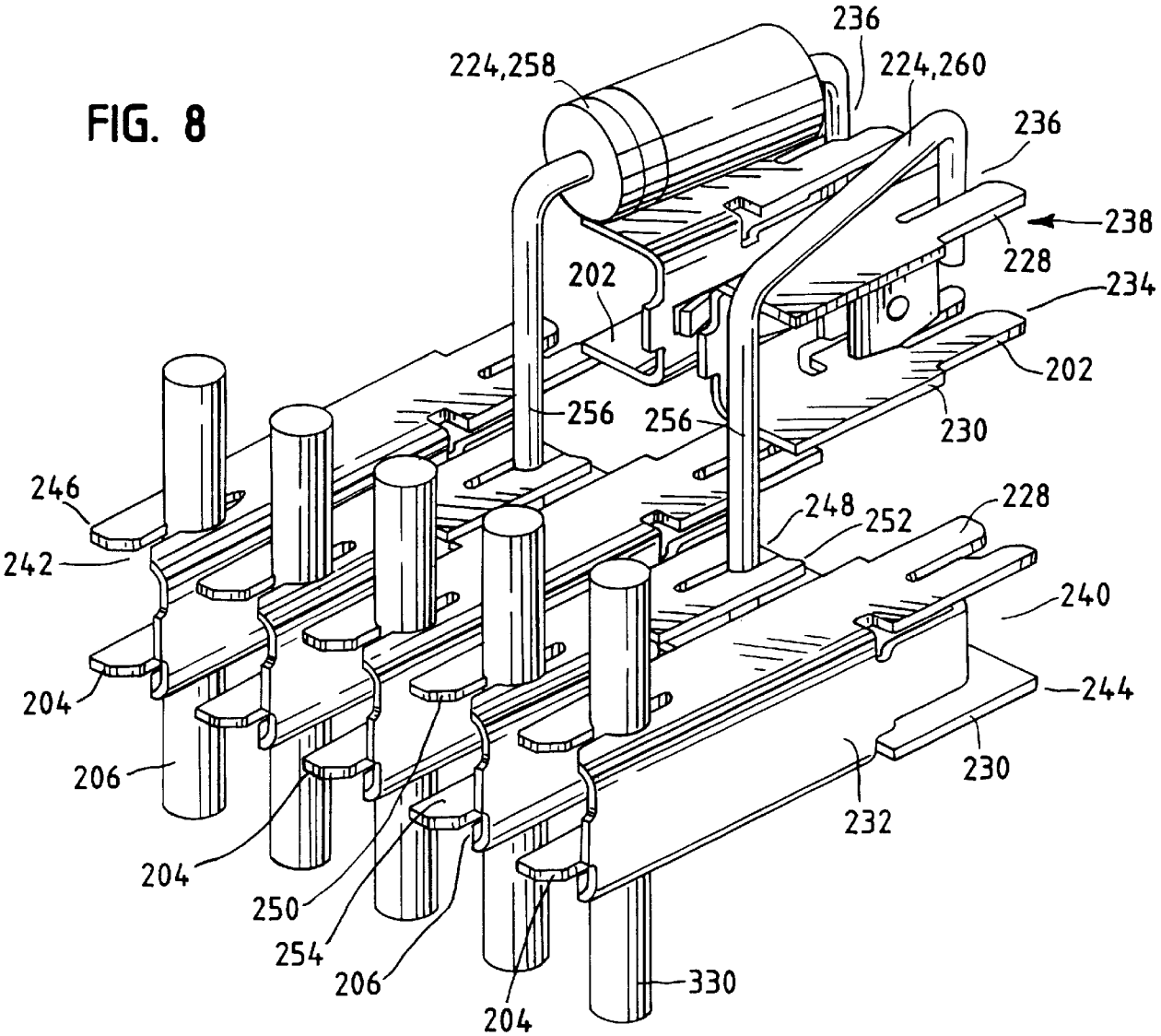
FIG. 8 illustrates a preferred contact design and preferred contact configuration incorporated in the second embodiment with circuit elements and external conductors in cooperation therewith.
Figure 9:
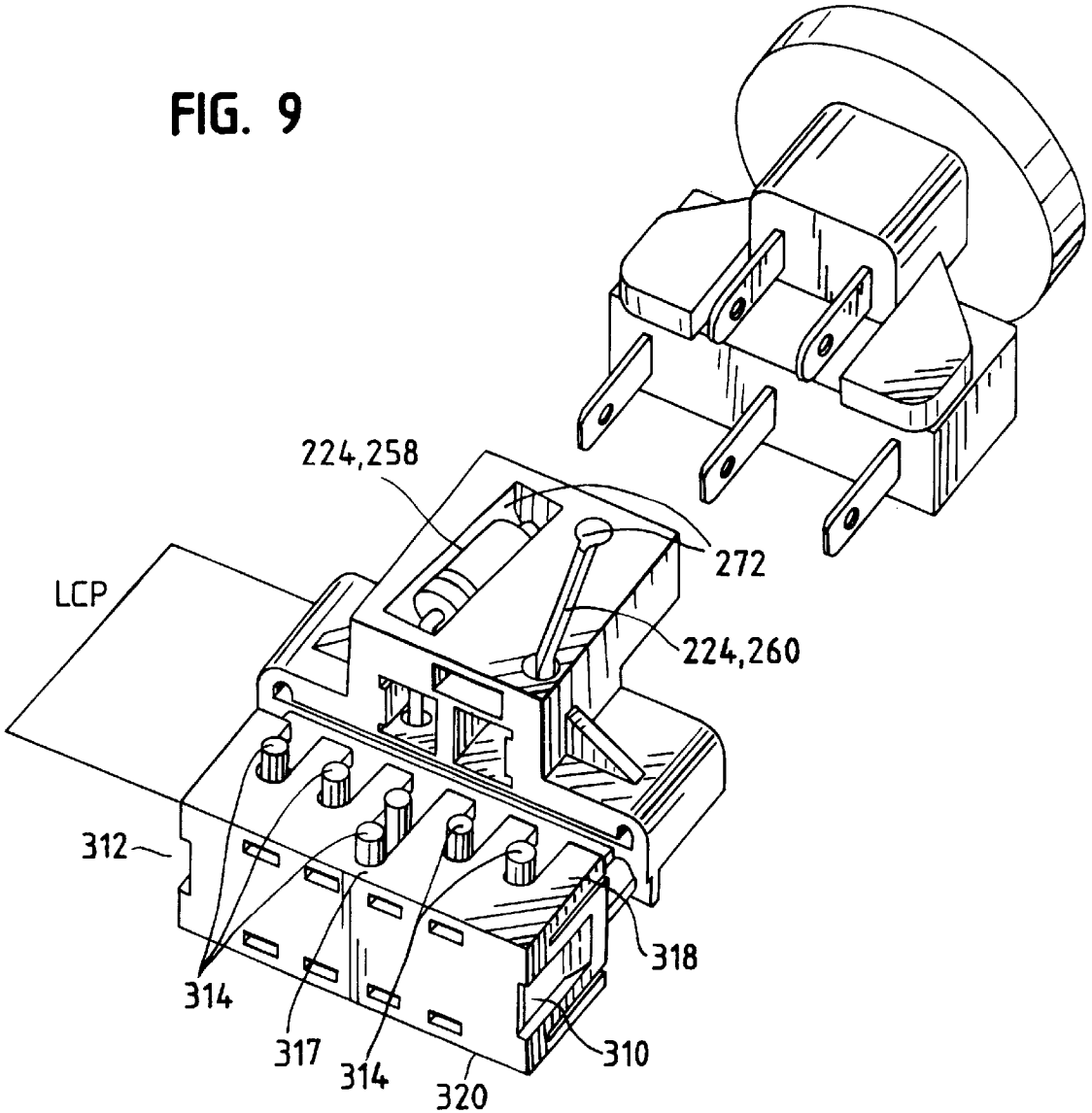
FIG. 9 depicts a second embodiment of the connector incorporating a housing with a top portion integral with a bottom portion in cooperation with an electrical assembly, and depicts external conductors, and depicts and end member and circuit elements in cooperation therewith.

FIG. 8 shows a detailed view of a preferred contact design and contact configuration of the second embodiment. Three different types of contacts 202, 204, 206 are shown: upper contacts 202; lower terminal contacts 204; and lower circuit element contacts 206. The upper contacts 202 are configured to cooperate with the upper (lamp) terminals 222 of the electrical assembly 14 and with a circuit element 224. The lower terminal contacts 204 are configured to cooperate with the lower (switch) terminals 218 of the electrical assembly 14 and the external conductors 226. The lower circuit element contacts 206 are configured to cooperate with the circuit elements 224 and the external conductors 226. Preferably, the lower terminal contacts 204 and lower circuit element contacts 206 define a lower cavity plane indicated at LCP, as shown in FIG. 9.

Each contact 202, 204, 206 has a design similar to contacts 24 of the first embodiment 10 described above. If desired, the contacts 202, 204, 206 can be identical to one another and incorporate the design of contacts 24 of the first embodiment 10.

As shown in FIG. 8, each contact 202, 204, 206 preferably includes first (top) and second (bottom) surfaces 228, 230 parallel to one another, and a third (lateral) surface 232 transverse, and preferably substantially orthogonal, to the first and second surfaces 228, 230.

The second embodiment includes at least one upper contact 202, at least one lower terminal contact 204, and at least one lower circuit element contacts 206. A first variation of the second embodiment (not shown) includes two upper contacts 202, two lower terminal contacts 204, and two lower circuit element contacts 206. In the first variation, at least one of the two upper terminals 222 of the electrical assembly 14 is in electrical contact with an external conductor 226, and at least one of three lower terminals 218 of the electrical assembly 14 is in electrical contact with an external conductor 226. Specifically, at least one of the two upper contacts 202 is in electrical contact with at least one of the two lower circuit element contacts 206 by way of a circuit element 224. The at least one of the two lower circuit element contacts 206 is in electrical contact with an external conductor 226. At least one of the two lower terminal contacts 204 is in electrical contact with an external conductor 226.

A preferred contact configuration of the second embodiment 200 incorporating the three different types of contacts 202, 204, 206 is shown in FIG. 8: (1) two upper contacts 202 include terminal receiving portions 234 and circuit element lead receiving portions 236 adjacent to one another and are located substantially at a proximal end 238 of the upper contact; (2) three lower terminal contacts 204 include terminal receiving portions 240 and external conductor receiving portions 242 spaced from one another substantially at proximal 244 and distal ends 246 of the lower terminal contacts 204; and (3) two lower circuit element contacts 206 include circuit element receiving portions 248 and external conductor receiving portions 250 spaced from one another substantially at proximal 252 and distal ends 254 of the lower circuit element contact 206.

In a preferred configuration, the terminal receiving portions 234, 240, external conductor receiving portions 242, 250, and circuit element lead receiving portions 236, 248 have a similar design and cooperate with the upper and lower terminals 222, 218, external conductors 226, and leads 256 of the circuit elements 224, respectively, as do the terminal receiving portions 28, conductor receiving portions 30, and circuit element lead receiving portions 74 of the first embodiment 10. It should be noted, however, that the contacts 202, 204, 206 and the respective terminal receiving portions 234, 240, external conductor receiving portions 242, 250, and circuit element lead receiving portions 236, 248 can be designed and configured differently, which different designs are within the scope and spirit of the present invention. Further, like the contact design of the first embodiment 10, the external conductor receiving portions 242, 250 need not be spaced from the terminal receiving portions 242 or the circuit element lead receiving portions 248 of the lower terminal contacts 204 and lower circuit element contacts 206, respectively. Likewise, the circuit element lead portions 236 need not be adjacent the terminal receiving portions 234 of the upper contacts 202.

Preferably, as shown in FIG. 8, the upper contacts 202 and lower circuit element contacts 206 are in electrical contact with one another by way of circuit elements 224. The circuit elements 224 can be, for example, a diode 258, a connecting wire 260 or the like. The upper terminal 222, which cooperates with the terminal receiving portion 234 of the upper contact 202, can thus be in electrical contact with an external conductor 226 by way of the lower circuit element contact 206, which includes its respective external conductor receiving portion 250. Thus, although both the upper and lower terminals 222, 218 of the electrical assembly 14 are in different planes, the external conductors 226 can be placed in electrical contact with the upper and lower terminals 222, 218 by connecting the external conductors 226 to the external conductor receiving portions 242, 250 of the lower terminal contacts 204 and lower circuit element contacts 206 in the lower cavity plane LCP. Such a configuration reduces labor costs by allowing only one machine to connect the external conductors 226 to the connector in one plane, as opposed to requiring a more elaborate machine or two machines to connect external conductors to the upper and lower terminals in two different planes.

As shown in FIG. 7, the housing 208 of the second embodiment 200 can include a top portion 262 that cooperates with a bottom portion 264 by male and female connectors 266, 268 formed on a top surface 296 of the bottom housing portion 264 and a bottom surface 270 of the top housing portion 262. The male connector 266 can be a ledge 267 formed on the top surface 296 of the bottom housing portion 264, and the female connector 268 can be a ledge receiving structure 269 formed on the bottom surface 270 of the top housing portion 262. In other embodiments not shown, the male connector 266 could be tabs depending from the bottom surface 270 of the top housing portion 262, and the female connector 268 could be openings formed within the top surface 296 of the bottom housing portion 264. Alternatively, the top portion 262 can be integral with the bottom portion 264 (FIG. 8).

The top portion 262 includes at least one upper cavity 210, and preferably, as shown in FIGS. 7 and 9, the top portion 262 includes two upper cavities 210. The top portion 262 also includes two circuit element receiving recesses 272 that are configured to receive circuit elements 224. The two circuit element receiving recesses 272 are formed within a top surface 274 of the top housing portion 262. The bottom portion 264 includes at least one lower terminal cavity 212 and at least one lower circuit element cavity 214. Preferably, as shown in FIG. 7, the bottom portion 264 includes three lower terminal cavities 212 parallel with two lower circuit element cavities 214. Preferably, the lower terminal cavities 212 and lower circuit element cavities 214 define the lower cavity plane LCP shown in FIG. 9 one another so that the contacts 202, 204, 206 are not in electrical contact with one another.

Preferably, as shown in FIG. 7, the two upper cavities 210 each include a terminal receiving portion 280 substantially at a proximal end 282 of the upper cavities 210, and two circuit element lead apertures 284 formed within each circuit element receiving recess 272. It should be noted, however, that the terminal receiving portion 280 need not be substantially at the proximal end 282 of the upper cavities 210. The terminal receiving portions 280 of the upper cavities 210 are configured to cooperate with the upper terminals 222 and the circuit element lead apertures 284 are configured to cooperate with the circuit element leads 256. The terminal receiving portions 280 and the circuit element lead apertures 284 can cooperate with the upper terminals 222 and circuit element leads 256, respectively, by receiving them. The upper contacts 202 are positioned within the upper cavities 210 so that their respective terminal receiving portions 234, 280 and circuit element lead portions 236 and apertures 284 are substantially aligned. Thus, when the electrical device 220 (light bulb in FIG. 6) is connected to the connector 200, the terminal receiving portions 280, 234 of the upper cavities 270 and contacts 202 receive the upper terminals 222 of the electrical assembly 14.

In the preferred embodiment of FIG. 7, the lower terminal cavities 212 each include a terminal receiving portion 286 substantially at a proximal end 288 of the lower terminal cavities 212. The lower terminal cavities 212 also include first and second external conductor openings 290, 292, substantially at a distal end 294, formed on top and bottom surfaces 296, 298 of the bottom housing portion 264. It should be noted that the positioning of the terminal receiving portion 286 and external conductor openings 290, 292 need not be at the proximal and distal ends 288, 294 of the lower terminal cavities 212. Preferably, as shown in FIGS. 7 and 9, the lower terminal contacts 204 are positioned within the lower terminal cavities 212 so that their respective terminal receiving portions 242, 286 are substantially aligned with one another and so that the external conductor receiving portions 242 and the first and second external conductor openings 290, 292 are substantially aligned with one another.

The preferred embodiment of FIG. 7 shows the lower circuit element cavities 214 each including a circuit element lead receiving aperture 300 substantially at a proximal end 302 of the lower circuit element cavity 214. The lower circuit element cavities 214 also include first and second external conductor openings 304, 306, at a distal end 308, formed at top and bottom surfaces 296, 298 of the bottom housing portion 264. It should be noted that the positioning of the circuit element lead receiving apertures 300 and external conductor openings 304, 306 need not be at the proximal and distal ends 302, 308 of the lower circuit element cavity 214. The lower circuit element contacts 206 of FIGS. 6 and 8 can be positioned within the lower circuit element cavities 214 so that their respective circuit element lead receiving portions 248 and circuit element lead apertures 300 are substantially aligned, and so that their respective external conductor receiving portions 250 and first and second external conductor openings 304, 306 are substantially aligned.

The second embodiment 200 can also include circuit elements 224 which can be positioned within the circuit element receiving recesses 272 of the top housing portion 262. The top housing portion 262 can then be connected to the bottom housing portion 264 (if a two part housing is used). Each contact 202, 204, 206 can then be positioned into its respective cavity 210, 212, 214 so that the circuit element receiving portions 236, 248 of the upper contacts 202 and the lower circuit element contacts 206 cooperate with the circuit element leads 256. The upper contacts 202 and lower circuit element contacts 206 would then be in electrical contact with one another via the circuit elements 226.

The housing-contact assembly (connector) 200 can be connected to the electrical assembly 14 so that the upper and lower terminals 222, 218 are in electrical contact with the appropriate contacts 202, 204, 206. The external conductors 226 can then be connected to the external conductor receiving portions 248, 242 of the lower circuit element contacts 206 and the lower terminal contacts 204 so that they are received in the connector 200 transverse, and preferably substantially orthogonal, to the lower cavity plane LCP. Thus, depending on the electrical circuit in which the connector is used, the lower terminals 218 of the electrical assembly 14 are connected to external conductors 226 via the lower terminal contacts 204, and the upper terminals 222 of the electrical assembly 14 are connected to the external conductors 226 via the upper terminal contacts 222, circuit elements 224, and lower circuit element contacts 206.

As shown in FIGS. 7 and 9, the second embodiment 200 could also include an end member 310 for cooperation with the distal end 312 of the connector 200. The end member 310 includes at least two upper and at least two lower apertures 314, 316. Preferably, as shown in FIGS. 7 and 9, the end member 310 includes five upper and lower apertures 314, 316 formed on top and bottom surfaces 318, 320 of the end member 310. Typically, the upper and lower apertures 314, 316 are of uniform size, but as shown in FIG. 9, one of the five upper and one of the five lower apertures 314, 316 can be elongated 317 to allow for cooperation with or storage of two external conductors 226. To allow for cooperation with the two external conductors, the external conductor receiving portion 242, 250 of the. respective lower terminal contact 204 or lower circuit element contact 206 would be shaped accordingly to cooperate with two external conductors 226. Alternatively, to allow for storage of the two external conductors 226, there need not be any respective lower terminal contact 204 or lower circuit element contact 206.

In addition, the end member 310 can have a male connector 322 and the housing 208 can have a female connector (not shown) to allow the end member 310 to cooperate with the housing 208. The male connector 322 of the end member 310 can be a ledge 324 depending from the top surface 318 of the end member 310, and the female connector (not shown) of the housing 208 can be a ledge (not shown) on a top surface 296 of the bottom housing portion 264. The housing 208 and end member 310 can cooperate with one another so that the first and second conductor openings 290, 292, 304, 306 of each. lower terminal cavity 212 and each lower circuit element cavity 214 are substantially aligned with the five upper and lower apertures 314, 316 of the end member 310. If desired, a loose end 330 of the external conductors 226, extending from the lower apertures 316 of the end member 310, can then be terminated.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. An insulated electrical connector for use with an associated switch, the switch including three protruding co-planar switch terminals parallel and spaced from one another, the connector comprising:

first, second, and third contacts, each contact including a terminal receiving portion configured to cooperate with one of the associated three switch terminals and an external conductor receiving portion configured to cooperate with an external conductor;

an insulating housing including at least three cavities parallel to one another and defining a cavity plane, each cavity including a terminal receiving portion and a first conductor opening formed therein; and a circuit element having two leads, wherein each contact includes a circuit element lead receiving portion in cooperation with one of the two circuit element leads, the insulated housing including at least two circuit element lead receiving apertures formed therein so that each circuit element lead is interposed within one of the at least two lead receiving apertures and are in electrical contact with a corresponding circuit element lead receiving portion, wherein each contact is positioned within the housing so that the terminal receiving portions of each contact and cavity are substantially aligned, the conductor receiving portion of the contacts and the conductor openings of the housing and cavities being substantially aligned and configured to receive an external conductor transverse to the cavity plane.

2. The connector of claim 1 wherein each contact includes first and second parallel surfaces integral with and substantially orthogonal to a third surface, the surfaces defining the terminal receiving portion at a proximal end and the conductor receiving portion at a distal end, the terminal receiving portion of each contact including a loaded beam configured to engage the associated switch terminal when the connector is connected to the associated switch, the conductor receiving portion of each contact including first and second grooves formed within the first and second parallel surfaces, each cavity including a second conductor opening, the first and second conductor openings substantially aligned with the first and second grooves.

3. The connector of claim 1 wherein the housing includes five cavities formed therein.

4. An insulated electrical connector for use with an associated switch, the switch including three protruding co-planar switch terminals parallel and spaced from one another, the connector comprising:

first, second, and third contacts, each contact including a terminal receiving portion configured to cooperate with one of the associated three switch terminals and an external conductor receiving portion configured to cooperate with an external conductor;

an insulating housing including at least three cavities parallel to one another and defining a cavity plane, each cavity including a terminal receiving portion and a first conductor opening formed therein; and a circuit element having two leads, wherein each contact includes a first set of insulation displacement connector beams formed on a second set of insulation displacement connector beams formed in each contact, the first set of insulation displacement connector beams defining a wide groove and the second set of insulation displacement connector beams defining a narrow groove, the insulated housing including three circuit element lead receiving apertures formed therein so that the two circuit element leads are interposed within two of the lead receiving apertures and are in electrical contact with at least one of the two corresponding sets of insulation displacement connector beams, wherein each contact is positioned within the housing so that the terminal receiving portions of each contact and cavity are substantially aligned, the conductor receiving portion of the contacts and the conductor openings of the housing and cavities being substantially aligned and configured to receive an external conductor transverse to the cavity plane.

5. The connector of claim 4 wherein each contact includes first and second parallel surfaces integral with and substantially orthogonal to a third surface, the surfaces defining the terminal receiving portion at a proximal end and the conductor receiving portion at a distal end, the terminal receiving portion of each contact including a loaded beam configured to engage the associated switch terminal when the connector is connected to the associated switch, the conductor receiving portion of each contact including first and second grooves formed within the first and second parallel surfaces, each cavity including a second conductor opening, the first and second conductor openings substantially aligned with the first and second grooves.

6. The connector of claim 4 wherein the housing includes five cavities formed therein.

7. An insulated electrical connector for use with an associated switch, the switch including three protruding co-planar switch terminals parallel and spaced from one another, the connector comprising:

first, second, and third contacts, each contact including a terminal receiving portion configured to cooperate with one of the associated three switch terminals and an external conductor receiving portion configured to cooperate with an external conductor;

an insulating housing including at least three cavities parallel to one another and defining a cavity plane, each cavity including a terminal receiving portion and a first conductor opening formed therein; and an end member configured to cooperate with the connector, the end member including three upper and lower apertures formed on top and bottom surfaces wherein each cavity includes second conductor openings formed therein so that when the end member is received by the conductor receiving section of the cavities, the upper and lower apertures are substantially aligned with the first and second conductor openings of the housing cavities, wherein each contact is positioned within the housing so that the terminal receiving portions of each contact and cavity are substantially aligned, the conductor receiving portion of the contacts and the conductor openings of the housing and cavities being substantially aligned and configured to receive an external conductor transverse to the cavity plane.

8. The connector of claim 7 wherein each contact includes first and second parallel surfaces integral with and substantially orthogonal to a third surface, the surfaces defining the terminal receiving portion at a proximal end and the conductor receiving portion at a distal end, the terminal receiving portion of each contact including a loaded beam configured to engage the associated switch terminal when the connector is connected to the associated switch, the conductor receiving portion of each contact including first and second grooves formed within the first and second parallel surfaces, each cavity including a second conductor opening, the first and second conductor openings substantially aligned with the first and second grooves.

9. The connector of claim 7 wherein the housing includes five cavities formed therein.

10. An insulated electrical connector for use with an associated electrical assembly including upper and lower terminals vertically spaced from one another, the insulated connector comprising:

at least one upper contact, the at least one upper contact including a terminal receiving portion configured to cooperate with an upper terminal of the associated electrical assembly and a circuit element lead receiving portion;

at least one lower terminal contact, the at least one lower terminal contact including a terminal receiving portion configured to cooperate with a lower terminal of the associated electrical assembly and an external conductor receiving portion configured to cooperate with an external conductor;

at least one lower circuit element contact, the at least one lower circuit element contact including a lead receiving portion configured to cooperate with a lead and an external conductor receiving portion configured to cooperate with an external conductor;

an insulated housing including at least one upper cavity above at least one lower circuit element cavity and at least one lower terminal cavity, the at least one lower circuit element cavity and the at least one lower terminal cavity defining a lower cavity plane, the at least one upper cavity including a terminal receiving portion and a lead aperture, the at least one lower terminal cavity including a terminal receiving portion and a first external conductor opening, the at least one lower circuit element cavity including a first external conductor opening and a lead aperture, at least one circuit element including first and second leads, wherein the contacts are positioned within the housing so that the terminal receiving portions of the at least one upper contact and cavity are substantially aligned, the lead receiving portion and the lead aperture of the at least one upper contact and cavity are substantially aligned, the terminal receiving portions of the at least one lower terminal contact and cavity are substantially aligned, the conductor receiving portion and the first conductor opening of the at least one lower terminal contact and cavity are substantially aligned, the lead receiving and conductor receiving portions of the at least one lower circuit contact are substantially aligned with the lead aperture and the first conductor opening of the at least one lower circuit cavity, and the first and second leads of the at least one circuit element are interposed within the lead apertures of the at least one upper cavity and the at least one lower circuit element cavity, the leads received by the lead receiving portions of the at least one upper contact and lower circuit element contact so that the at least one upper contact is in electrical contact with the at least one lower circuit element contact, the conductor receiving portions and the first conductor openings of each of the at least one lower terminal cavity and the at least one lower circuit element cavity configured to receive an external conductor transverse to the lower cavity plane.

11. The connector of claim 10 wherein the at least one upper contact includes first and second parallel surfaces integral with and substantially orthogonal to a third surface, the surfaces of the at least one upper contact defining the terminal receiving portion at a proximal end, the terminal receiving portion including a loaded beam configured to engage an upper terminal of the associated electrical assembly, the lead receiving portion of the at least one upper contact including one set of insulation displacement connector beams formed on a second set of insulation displacement connector beams formed on the first or second surfaces, the first set of insulation displacement connector beams defining a wide groove and the second set of insulation displacement connector beams defining a narrow groove, the at least one lower terminal contact comprising first and second parallel surfaces integral with and substantially orthogonal to a third surface, the surfaces of the lower terminal contact defining the terminal receiving portion at a proximal end, the terminal receiving portion of the at least one lower terminal contact including a loaded beam configured to engage a lower terminal of the associated electrical assembly, the conductor receiving portion of the at least one lower terminal contact including first and second grooves formed within the first and second parallel surfaces, the at least one lower terminal cavity including a second conductor opening, the first and second conductor openings of the at least one lower terminal cavity substantially aligned with the first and second grooves of the at least one lower terminal contact, the at least one lower circuit element contact comprising first and second parallel surfaces integral with and substantially orthogonal to a third surface, the lead receiving portion of the at least one lower circuit element contact including a first set of insulation displacement connector beams formed on a second set of insulation displacement connector beams formed on the first or second surfaces, the first set of insulation displacement connector beams defining a wide groove the second set of insulation displacement connector beams defining a narrow groove, and the conductor receiving portion of the at least one lower circuit contact including first and second grooves formed within the first and second surfaces, the at least one lower circuit element cavity including a second conductor opening formed therein, the first and second conductor openings of the at least one circuit element cavity substantially aligned with the first and second grooves of the at least one lower circuit element contact.

12. The connector of claim 10 wherein the at least one circuit element is a diode or a wire.

13. The connector of claim 10 wherein the connector comprises two upper contacts and cavities, three lower terminal contacts and cavities, two lower circuit element contacts and cavities, and two circuit elements, each circuit element cooperating with one upper contact and cavity and one lower circuit element contact and cavity.

14. The connector of claim 13 wherein the insulated housing comprises a top portion attached to a bottom portion, the top portion including the two upper cavities and the lower portion including the two lower circuit element cavities and three lower terminal cavities.

15. The connector of claim 14 wherein the top and bottom portions are integral with one another.

16. The connector of claim 14 wherein the housing includes male and female connectors for connecting the top portion to the bottom portion, the male and female connectors cooperating with one another.

17. The connector of claim 16 wherein the top portion includes bottom and top surfaces vertically spaced from one another, and the bottom portion includes bottom and top surfaces vertically spaced from one another, a female connector formed on the bottom surface of the top portion and a male connector formed on the top surface of the bottom portion.

18. The connector of claim 10 further comprising an end member configured to cooperate with the connector, the end member including at least two upper and at least two lower apertures formed on top and bottom surfaces of the end member, wherein the at least one lower terminal cavity and at least one lower circuit element cavity include second conductor openings formed therein so that, when the end member is received by the connector, the first and second conductor openings of the at least one lower terminal cavity and the at least one lower circuit cavity are substantially aligned with the at least two upper and the at least two lower apertures of the end member.

19. The connector of claim 18 wherein the connector comprises two upper contacts and cavities, two lower terminal contacts, three lower terminal cavities, and two lower circuit element contacts and cavities, the end member including five upper and five lower apertures formed therein, one of the five upper apertures being elongated.

20. An insulated connector for use with an associated switch including three terminals coupled to an associated electrical device including two terminals, the insulated connector comprising:

two upper contacts, each upper contact including a terminal receiving portion configured to receive a terminal of the associated electrical device and a circuit element lead receiving portion;

three lower terminal contacts, each lower terminal contact including a terminal receiving portion configured to receive a terminal of the associated switch and an external conductor receiving portion;

two lower circuit element contacts, each lower circuit contact including a lead receiving portion and an external conductor receiving portion;

an insulated housing including an upper portion and a lower portion, the upper portion including two upper cavities, and the lower portion including three lower terminal cavities and two lower circuit element cavities, the three lower terminal cavities and two lower circuit cavities defining a lower cavity plane, the two upper cavities including a terminal receiving portion and a lead aperture, the three lower terminal cavities including a terminal receiving portion and a first external conductor opening, the two lower circuit element cavities including a first external conductor opening and a lead aperture, two circuit elements, each circuit element including first and second leads;

the contacts positioned within the housing so that the terminal receiving portion of each upper contact and cavity are substantially aligned, the lead receiving portion and lead aperture of each upper contact and cavity are substantially aligned, the terminal receiving portion of each lower terminal contact and cavity are substantially aligned, the conductor receiving portion and the first conductor opening of each lower terminal contact and cavity are substantially aligned, the lead receiving and conductor receiving portions of each lower circuit contact are substantially aligned with the lead aperture and the first conductor opening of each lower circuit cavity, and the first and second leads of each circuit element are interposed within the lead apertures of the upper cavities and the lower circuit element cavities, the leads received by the lead receiving portions of each upper contact and each lower circuit contact so that each upper contact is in electrical contact with each lower circuit element contact, wherein the conductor receiving portions of each of the lower terminal contacts and the lower circuit elements, and the first conductor opening of the lower terminal cavities and the lower circuit element cavities are configured to receive an external conductor transverse to the lower cavity plane.

21. The connector of claim 20 wherein the housing includes male and female connectors for connecting the top portion to the bottom portion, the male and female connectors cooperating with one another.

22. The connector of claim 20 wherein each upper contact comprises first and second parallel surfaces integral with and substantially orthogonal to a third surface, the surfaces of each upper contact defining the terminal receiving portion at a proximal end, the terminal receiving portion including a loaded beam configured to engage a terminal of the associated electrical device, the lead receiving portion of each upper contact including a first set of insulation displacement connector insulation displacement connector beams formed on a second set of insulation displacement connector beams formed on the first or second surfaces, the first set of insulation displacement connector beams defining a wide groove, the second set of insulation displacement connector beams defining a narrow groove, each lower terminal contact comprising first and second parallel surfaces integral with and substantially orthogonal to a third surface, the surfaces of the lower terminal contact defining the terminal receiving portion at a proximal end, the terminal receiving portion of each lower terminal contact including a loaded beam configured to engage a terminal of the associated switch, the conductor receiving portion of each lower terminal contact including first and second grooves formed within the first and second parallel surfaces, the lower terminal cavity including a second conductor opening, the first and second conductor openings of the lower terminal cavity substantially aligned with the first and second grooves of the lower terminal contact, each lower circuit element contact comprising first and second parallel surfaces integral with and substantially orthogonal to a third surface, the lead receiving portion including a first set of insulation displacement connector beams formed on a second set of insulation displacement connector beams formed on the first or second surfaces, the first set of insulation displacement connector beams defining a wide groove, the second set of insulation displacement connector beams defining a narrow groove, and the conductor receiving portion of the lower circuit contact including first and second conductor receiving grooves formed within the first and second surfaces, the lower circuit element cavity including a second conductor opening formed therein, the first and second conductor openings of the circuit element cavity substantially aligned with the first and second grooves of the lower circuit element contact.

23. The connector of claim 20 further comprising an end member configured to cooperate with the connector, the end member defining five top and bottom apertures formed on top and bottom surfaces of the end member, wherein each lower terminal cavity and each lower circuit cavity include second conductor openings formed therein so that, when the end member is received by the connector, the first and second conductor openings of the lower terminal and circuit cavities are substantially aligned with the five top and bottom apertures of the end member.

* * * * *